US007427174B2

(12) United States Patent
Dearing

(10) Patent No.: US 7,427,174 B2
(45) Date of Patent: Sep. 23, 2008

(54) ELECTRICALLY HEATED PAVING SCREED

(75) Inventor: Keith Dearing, Kings Lynn (GB)

(73) Assignee: Caterpillar Paving Products Inc., Minneapolis, MN (US)

( * ) Notice: Subject to any disclaimer, the term of this patent is extended or adjusted under 35 U.S.C. 154(b) by 360 days.

(21) Appl. No.: 10/481,467

(22) PCT Filed: Jun. 20, 2002

(86) PCT No.: PCT/EP02/06992

§ 371 (c)(1),
(2), (4) Date: Sep. 27, 2004

(87) PCT Pub. No.: WO03/000995

PCT Pub. Date: Jan. 3, 2003

(65) Prior Publication Data

US 2005/0069384 A1 Mar. 31, 2005

(30) Foreign Application Priority Data

Jun. 20, 2001 (GB) ..... 0115039.0

(51) Int. Cl.
*E01C 23/14* (2006.01)

(52) U.S. Cl. ..... 404/95; 404/118

(58) Field of Classification Search ..... 404/77, 404/79, 90–96, 101–103, 72, 75, 114, 118, 404/84.1

See application file for complete search history.

(56) References Cited

U.S. PATENT DOCUMENTS

| | | | | |
|---|---|---|---|---|
| 2,303,812 | A | 12/1942 | Barber | |
| 5,417,516 | A | 5/1995 | Birtchet | |
| 6,124,580 | A * | 9/2000 | Nottmeier et al. | 219/635 |
| 6,421,594 | B1 * | 7/2002 | Erasmus | 701/50 |
| 2004/0086336 | A1 * | 5/2004 | Nelson | 404/72 |
| 2004/0144765 | A1 * | 7/2004 | Heindtel | 219/213 |

FOREIGN PATENT DOCUMENTS

| | | |
|---|---|---|
| DE | 19836650 A1 | 2/2000 |
| JP | 7-300813 | 11/1995 |

* cited by examiner

*Primary Examiner*—Gary S Hartmann
(74) *Attorney, Agent, or Firm*—Finnegan, Henderson, Farabow, Garrett & Dunner

(57) ABSTRACT

This invention relates to screeds used for compacting paving material. The invention provides a screed for a paving machine comprising a sole plate; a tamper adjacent the sole plate; a heating element mounted on the sole plate; and a heat conductor mounted on the sole plate and arranged to conduct heat from the heating element to the tamper.

13 Claims, 3 Drawing Sheets

ELECTRICALLY HEATED PAVING SCREED

TECHNICAL FIELD

This invention relates to screeds used for compacting paving material and, in particular, to heating a screed and associated tamper bar.

BACKGROUND

When laying a surface on a pavement or road, a heated asphalt paving material is spread onto a prepared bed and spread out while still hot. The paving material is then compacted so that a hard surface is formed upon cooling. Paving vehicles generally have a compacting device known as a screed, having a substantially flat sole plate, mounted on the rear of the vehicle so that the paving material is compacted as the vehicle moves forward and pulls the device over the paving material. The screed is usually made from steel or other heavy material and is mounted on pivotable arms which allow the screed to move up and down in the vertical direction over the paving material. Conventional screeds often have vibrators mounted on the sole plate and the resulting vibration of the sole plate, together with the weight of the screed, serves to compact the heated paving material.

Conventional screeds often also include a tamper which is a bar mounted forwards of the sole plate and driven by means of an eccentric drive. The tamper effectively pre-compacts the paving material before compacting by means of the sole plate occurs.

The sole plate and tamper must be heated, otherwise the paving material begins to harden upon coming into contact with the screed, and adheres to the screed causing a build up of material on the screed which causes an undesirable drag on the paving vehicle, and leaves marks or open textures on the hardened paving material. In particular, it is important that the tamper is heated, which can pose difficulties as the tamper bar is constantly reciprocating. The sole plate must also be heated, as the sole plate can become bound to the tamper, and hinder the reciprocating motion, if the heated paving material binds to the sole plate upon cooling.

Known methods of heating the tamper include provision of a heating element in the tamper bar. However, the electrical supply to the heating element often becomes faulty due to the repeated motion of the tamper.

U.S. Pat. No. 6,124,580 provides a possible solution to this problem by the application of a high frequency electric current to a coil connected with the sole plate so as to induce eddy currents in the tamper in order to heat the tamper bar as the tamper moves with respect to the coil. However, that solution requires the use of a high frequency current, and the tamper bar will not be heated until there is relative motion between the tamper bar and the coil.

The present invention is directed to overcoming one or more of the problems set forth above.

SUMMARY OF THE INVENTION

According to the present invention there is provided a screed for a paving machine comprising a soleplate; a tamper adjacent the soleplate; a heating element mounted on the soleplate; and a heat conductor mounted on the soleplate, the heat conductor being arranged to conduct heat from the heating element to the tamper.

According to another aspect of the invention there is provided a method of heating a tamper for a paving screed. The screed has a sole plate having an electrical heating element and a heat conductor positioned between the sole plate and the tamper. The method includes the steps of supplying electrical power to the heating element and heating the sole plate, and heating the tamper by conducting heat from the sole plate to the tamper through the heat conductor.

BRIEF DESCRIPTION OF THE DRAWINGS

An embodiment of the present invention will now be described, by way of example only, with reference to the accompanying drawings in which.

DETAILED DESCRIPTION

In this description, forward refers to the direction of movement of a paving vehicle upon which a paving screed is mounted, and rearward refers to the opposite direction. Similarly, the front of the paving screed is the side of the screed which in use is mounted closest to the paving vehicle, and the back of the screed is the side of the screed mounted furthest from the paving vehicle.

Figure 1:
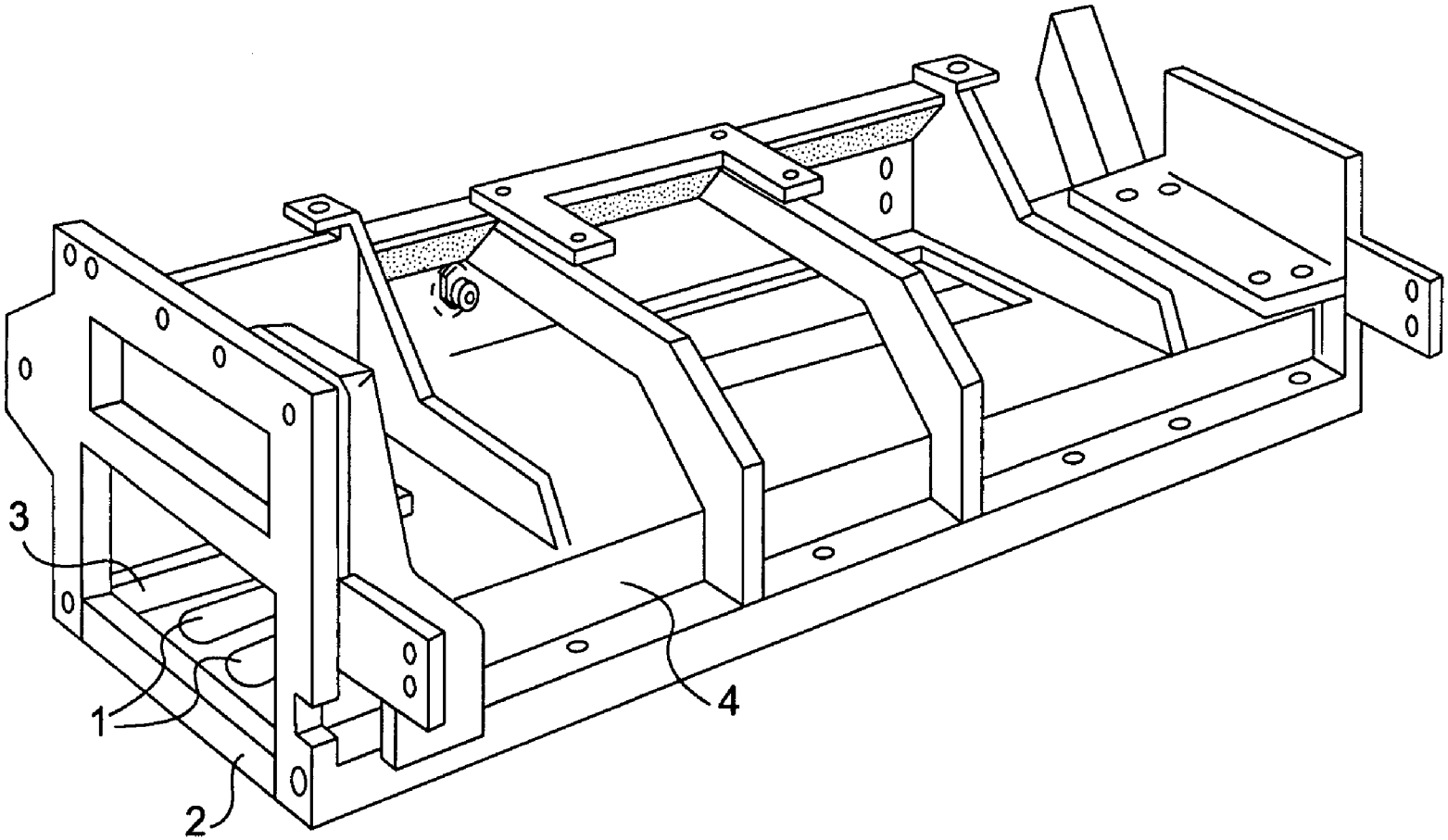
FIG. 1 is a perspective view of part of a screed according to the embodiment of the present invention.

FIG. 1 shows part of a paving screed in which resistive heating elements 1 can be seen mounted on a sole plate 2. A first heat conductor 3 is mounted at the front of the screed, such that heat generated by the heating elements 1 is conducted forwards towards the front edge of the screed.

It is an advantage if the heating element 1 is a tubular element arranged such that electrical connectors for connecting the element to a power source (not shown) are central to the sole plate 2.

In a preferred embodiment, the body 4 of the paving screed is fabricated from iron which has a thermal conductivity of 80 W/m/K. Consequently heat generated by the heating elements 1 is conducted relatively slowly by the body 4 of the screed. The sole plate 2 is fabricated from the steel alloy Hardox™, which has a similarly low thermal conductivity. Other materials having suitable thermal conductivity can be readily substituted for these materials by one skilled in the art.

Figure 2:
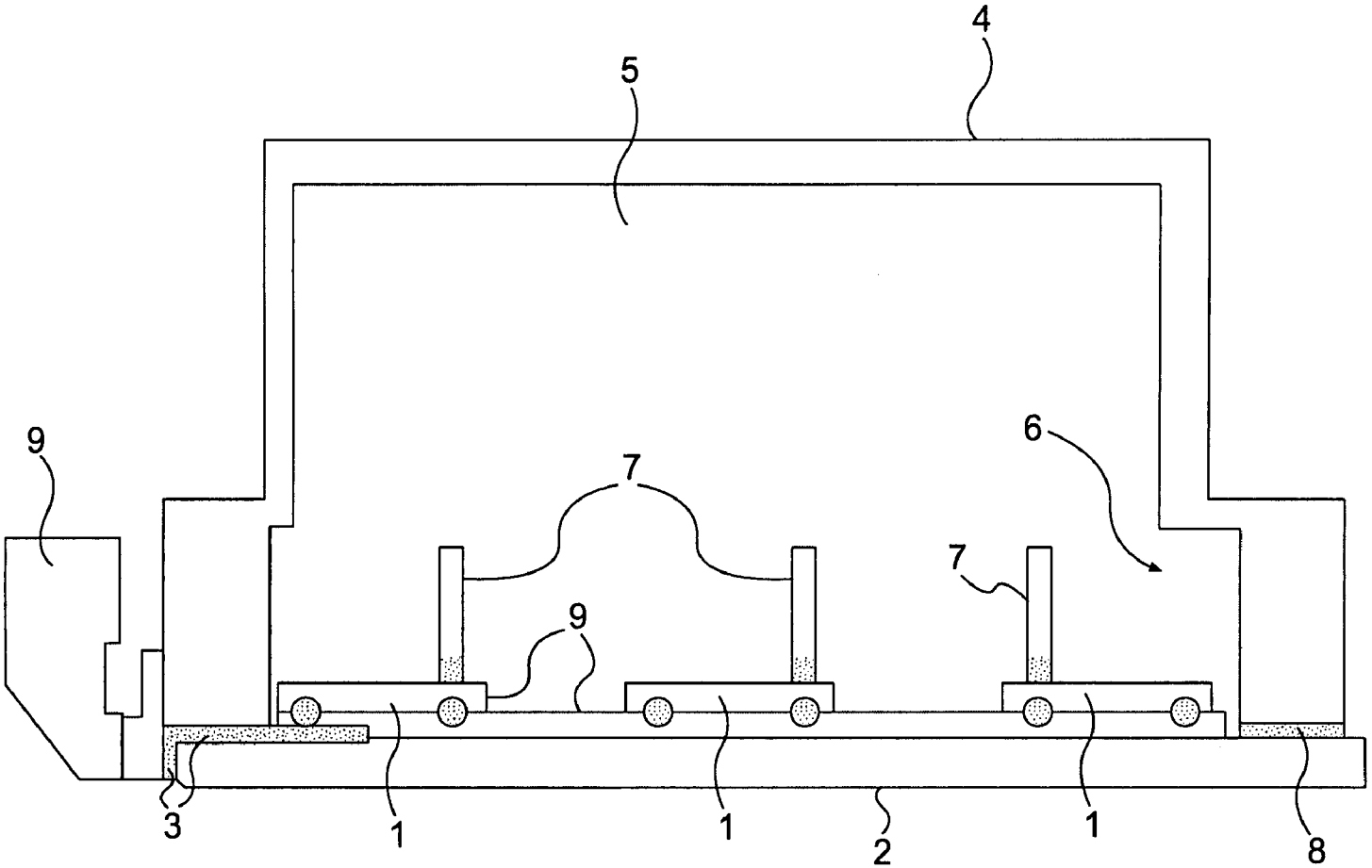
FIG. 2 is a cross-sectional side view of a screed according to the embodiment of the present invention.

FIG. 2 is a side view of a screed according to the present invention. The body 4 surrounds a cavity 5 which is filled with fibre insulation 6. The tubular heating elements 1 are connected via connectors 7 to a power source (not shown). The heating elements 1 are thermally coupled to the sole plate 2 via a second heat conductor 9. At the rear of the screed the sole plate 2 is thermally insulated from the body 4 using insulating material 8.

A tamper 10 is mounted at the front of the screed, and is driven by an eccentric drive (not shown) to provide reciprocating motion of, for example, about 4 mm in a substantially vertical direction. The forward edge of the tamper 10 is angled to aid feeding of the paving material under the screed when the screed is in use.

The first heat conductor 3 is mounted forwards of the heating elements 1 such that generated heat is conducted towards the front of the screed, and causes the tamper 10 to be heated. Thus, hot paving material which is fed under the screed during use is less likely to adhere to the tamper 10 than if the tamper 10 is not heated.

Preferably the heat conductors 3, 9 have a thermal conductivity greater than around 160 W/mK. In this preferred embodiment, the heat conductors 3, 9 are aluminium which has a thermal conductivity of 220 W/mK. Copper, with a thermal conductivity of 390 W/mK could be used, but copper is much more expensive than aluminium. Alloys, other metals, or other materials could be used as long as the thermal conductivity is sufficiently high.

Figure 3:
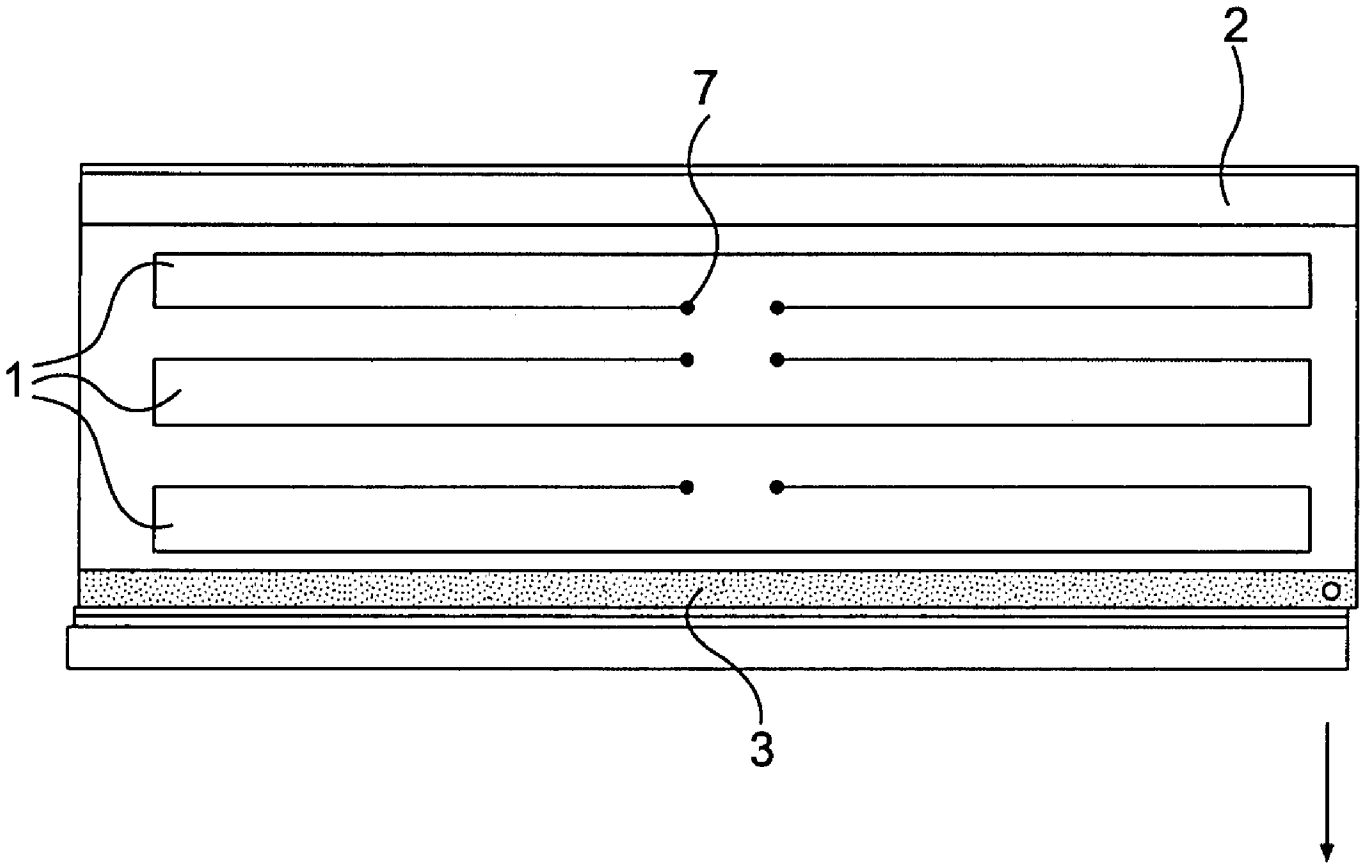
FIG. 3 is a plan view of the sole plate of a screed according to the embodiment of the present invention.

FIG. 3 shows a plan view of a screed sole plate 2 having three heating elements 1. In this view, it can be seen that the connectors 7 for the heating elements 1 are mounted centrally, such that there is part of a heating element 1 between each connector 7 and an edges of the sole plate 2. The arrangement shown is advantageous because it reduces the occurrence of cold spots in the sole plate 2 which may occur if the connectors 7 are mounted close to the edges of the sole plate 2.

The described embodiment of the present invention illustrates the heating elements 1 mounted on the sole plate 2. It would be obvious to one skilled in the art to also mount the heating element 1 within the sole plate 2 instead of on it. This and other routine modifications are within the skill of the competent designer and are intended to be within the scope of the appended claims and their legal equivalents.

The invention claimed is:

1. A screed for a paving machine comprising:

a sole plate;

a tamper positioned adjacent the sole plate;

at least one electrical heating element mounted exclusively on the sole plate; and a heat conductor mounted on the sole plate, the heat conductor being arranged to conduct heat from said at least one heating element to the tamper to provide the primary source for heating the tamper.

2. A screed according to claim 1, in which said at least one heating element is a tubular element arranged such that electrical connectors for connecting said at least one heating element to a power source are central to the sole plate.

3. A screed according to claim 1, in which the heat conductor has a thermal conductivity greater than around 160 W/mK.

4. A screed according to claim 3, in which the heat conductor is aluminum.

5. A screed according to claim 3, in which the heat conductor is copper.

6. A method of heating a tamper for a paving screed, said screed including a sole plate having at least one electrical heating element, and a heat conductor positioned between said sole plate and said tamper, comprising the steps of:

supplying electrical power to said at least one heating element and heating said sole plate; and heating said tamper by conducting heat from said sole plate to said tamper through said heat conductor, said at least one heating element providing the primary source for heating said tamper.

7. A screed for a paving machine comprising:

a sole plate;

a tamper positioned adjacent the sole plate;

at least one electrical heating element mounted exclusively on the sole plate, the at least one electrical heating element including a resistive heating element; and a heat conductor mounted on the sole plate, the heat conductor being arranged to conduct heat from the at least one heating element to the tamper to provide the primary source for heating the tamper.

8. A screed according to claim 7, wherein the resistive heating element heats both the sole plate and the tamper.

9. A screed according to claim 7, wherein the heat conductor is mounted at the front of the sole plate.

10. A screed according to claim 7, wherein the sole plate is thermally insulated from a body of the paving machine.

11. A screed according to claim 1, wherein the heat conductor is mounted at the front of the sole plate.

12. A screed according to claim 1, wherein the sole plate is thermally insulated from a body of the paving machine.

13. A screed according to claim 6, further including:

insulating the sole plate from a body of the paving machine.

* * * * *